US005699924A

United States Patent [19]

Mascio et al.

[11] Patent Number: 5,699,924

[45] Date of Patent: Dec. 23, 1997

[54] ATTACHMENT OF TAMPER-EVIDENCING BAND TO CLOSURE SKIRT

[75] Inventors: Nicholas A. Mascio; Douglas S. Martin, both of New Castle, Pa.

[73] Assignee: Portola Packaging, Inc., San Jose, Calif.

[21] Appl. No.: 638,033

[22] Filed: Apr. 26, 1996

[51] Int. Cl.[6] ..... B65D 41/32; B65D 41/52; B65D 47/10

[52] U.S. Cl. ..... 215/252; 215/330; 215/331; 222/541.5; 222/568

[58] Field of Search ..... 215/252, 256, 215/318, 330, 331, 329; 222/566, 567, 570, 573, 541.1, 541.5, 541.6, 541.9, 568

[56] References Cited

U.S. PATENT DOCUMENTS

| | | | |
|---|---|---|---|
| 2,998,902 | 9/1961 | Thomas et al. . | |
| 3,504,818 | 4/1970 | Crisci et al. . | |
| 3,682,345 | 8/1972 | Baugh . | |
| 3,902,621 | 9/1975 | Hidding . | |
| 3,963,139 | 6/1976 | Gach . | |
| 3,980,195 | 9/1976 | Fillmore . | |
| 4,034,882 | 7/1977 | Wright . | |
| 4,053,077 | 10/1977 | De Felice . | |
| 4,084,716 | 4/1978 | Bogert . | |
| 4,330,067 | 5/1982 | Deussen . | |
| 4,469,253 | 9/1984 | Beard . | |
| 4,500,016 | 2/1985 | Funtstuck . | |
| 4,561,553 | 12/1985 | Crisci . | |
| 4,589,561 | 5/1986 | Crisci . | |
| 4,625,875 | 12/1986 | Carr et al. . | |
| 4,682,706 | 7/1987 | Devore et al. | 215/256 X |
| 4,749,103 | 6/1988 | Barriac . | |
| 4,779,764 | 10/1988 | Debetencourt . | |
| 4,801,032 | 1/1989 | Crisci . | |
| 4,805,807 | 2/1989 | Perne et al. . | |
| 4,813,577 | 3/1989 | Carow . | |
| 4,826,055 | 5/1989 | Stull . | |
| 4,927,065 | 5/1990 | Beck . | |
| 4,936,474 | 6/1990 | Szczesniak et al. | 215/256 X |
| 4,936,475 | 6/1990 | Montgomery | 215/252 |
| 4,948,003 | 8/1990 | Munoz . | |
| 4,993,571 | 2/1991 | Conti | 215/256 X |
| 5,097,974 | 3/1992 | Rozenberg | 215/256 X |
| 5,104,008 | 4/1992 | Crisci . | |
| 5,105,960 | 4/1992 | Crisci et al. . | |
| 5,143,235 | 9/1992 | Repp | 215/256 |
| 5,197,619 | 3/1993 | Margaria | 215/256 |
| 5,373,954 | 12/1994 | Julian | 215/256 |
| 5,413,235 | 5/1995 | Decelles | 215/252 |
| 5,450,972 | 9/1995 | Zemlo | 215/318 X |
| 5,456,375 | 10/1995 | May | 215/256 X |
| 5,465,876 | 11/1995 | Crisci . | |
| 5,588,562 | 12/1996 | Sander et al. | 215/252 X |

FOREIGN PATENT DOCUMENTS

| | | |
|---|---|---|
| 2216505 | 10/1989 | United Kingdom . |

*Primary Examiner*—Allan N. Shoap
*Assistant Examiner*—Nathan Newhouse
*Attorney, Agent, or Firm*—Julian Caplan Flehr Hohbach Test Albritton & Herbert

[57] ABSTRACT

A plastic container closure has a skirt which is connected to a tamper-evidencing band by frangible bridges, all molded in a single unit. Where the closure is a cap for a container neck, there is at least one retaining means on the skirt and another on the band. The neck has two retaining means which cooperate with those on the cap to prevent upward movement of the cap without fracture of the bridges. To reduce the likelihood of unintentional fracture of the bridges, particularly during installation of the cap on the neck, plural ejection bumpers of extended arcuate lengths are located on the top edge of the band and or from the bottom edge of the skirt and the bridges are located between the bumpers. This snap lock ring functions to replace the conventional retaining means located centrally of the band. The invention is applicable to tamper-evidencing bands of closures and of push/pull closures of sports-type cap spouts.

10 Claims, 2 Drawing Sheets

ATTACHMENT OF TAMPER-EVIDENCING BAND TO CLOSURE SKIRT

BACKGROUND OF THE INVENTION

1. Field of the Invention

This invention relates to a new and improved tamper-evidencing means. More particular the present invention relates to a snap-lock ring on the stem or neck of a container which engages the top edge of a tamper-evidencing band located below the skirt of a cap, or spout, or other closure, the skirt and band being connected by plurality of frangible bridges.

2. Prior Art

In one form of the invention, hereinafter described, a push/pull spout is located on the stem of a cap extending upward from the cap used to close the opening of the neck of a container. Tamper-evidencing of such a push/pull spout is disclosed in Crisci U.S. Pat. No. 5,465,876. It will be understood, however, that tamper-evidencing by use of drop bands may be applied to hold flat top caps on the necks of containers where the cap skirt is connected to a drop band by frangible bridges as is shown, for example, in Carr U.S. Pat. No. 4,625,875.

Heretofore the drop band has been formed with a retaining means located intermediate its top and bottom edges which engage a cooperating tamper-evidencing means on the stem or neck. In accordance with the present invention, a ring is formed on the stem or neck which engages the top edge of the drop band so that the spout, whether of the push/pull type or is a cap of the flat top type, cannot be raised without fracturing the bridges connecting the skirt and band and thereby giving evidence of tampering.

To facilitate ejection of the molded parts from the mold, bumpers have been formed on the top edge of the band and/or the bottom edge of the skirt above the band. These bumpers reduce the likelihood of the bridges being unintentionally fractured during mold ejection and installation of the spout on the stem or neck. Such bumpers are shown on the bottom of the skirt in U.S. Pat. No. 4,625,875 as well as elsewhere in the art. In accordance with the present invention, the arcuate length of the bumpers has been increased and correspondingly the number and thickness of the bridges spaced between the bumpers reduced.

SUMMARY OF THE INVENTION

The invention will be described in connection with a push/pull closure used with sports water bottles. Such closures have a cap portion which fits onto the neck of the container. The present invention may be used in conjunction with the retention of the main cap and the container neck.

The spout skirt is spaced above a drop band, the upper surface of the drop band having, as illustrated herein, four bumpers each of an arcuate length of approximately 45°. Spaced between each pair of bumpers is a bridge which connects the drop band to the lower edge of the skirt. So long as the bridges are intact, evidence is provided that there has been no tampering with the contents of the container.

The spout has a stem or neck on which is an external bead and either as an integral part or projecting outwardly from the bead is a snap-lock ring so located and dimensioned that when the push/pull spout is seated on the stem the snap-lock ring engages the top edge of each bumper and likewise bows the bridges outwardly.

It will be understood that the main closure used with the push/pull cap heretofore described or a flat top cap may be similarly attached to the neck of a container. The present invention may be used with such a structure as well as with a push/pull cap.

Heretofore beads have been formed in the drop band which engage grooves in the exterior of the cap stem, such beads being created by an undercut in the mold from which the spout is molded. In order to release this area from the mold, a radius is formed which allows the band to slide over the steel ledge of the mold instead of damaging the bead. If the strength of the bridges is reduced by making them smaller in cross-section, then there is a possibility that the bridges may break when the cap is assembled on the neck or stem. If, on the other hand, the bridges are strengthened to reduce the likelihood of breakage on assembly, then it has been found that the spout is difficult for the consumer to open.

The above problems have been solved by the present invention. Because of the structure hereinafter described, the strengths of the bridges (i.e., their thickness in molding) may be reduced. Even though the bridges are reduced in size, the spout may be assembled on the cap stem without breaking. The need for an undercut ring in the drop band is eliminated. Hence molding capabilities are improved and ejection of the part from the mold is expedited.

Further, in accordance with the present invention, the number of bridges may be reduced and hence the force required to open the spout is likewise reduced.

A feature of the invention is that the use Of a plurality of bumpers spaced around the upper edge of the drop band results in the engagement of two flat surfaces to provide resistance to break the drop band. It is understood that the bumpers could be on the end of the cap skirt and the engagement be the full top surface of the drop band. Use of bumpers to reduce breakage is accomplished through the use of the snap-lock ring on the band of the stem to engage the flat surface of the ejection bumpers in the opening between the band and the bottom edge of the cap skirt. The ejection bumpers are increased in arcuate length to provide more contact surface and reduced in height to increase the opening to engage the cap-locking ring. The overlap of the lock is reduced thereby reducing required expansion of the tamper-evidencing band during assembly. Since there is less expansion during assembly, the bridges may be designed to break more easily.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The present invention may be used with push/pull caps used on sports bottles. Such a use is hereinafter described and is illustrated in the accompanying drawings. However, it will be understood that the same features may be used to connect the drop bands of a flat top cap to the superimposed cap skirt.

Figure 1:
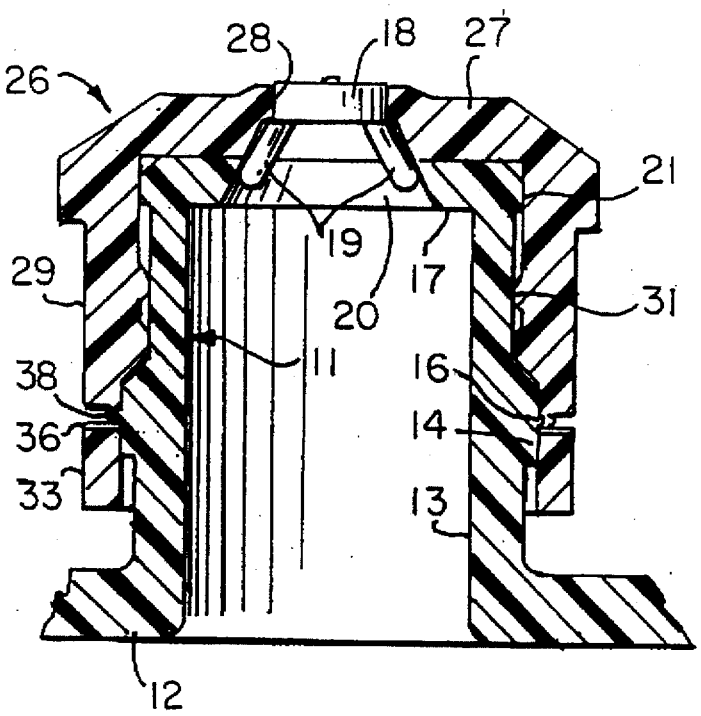
FIG. 1 is a sectional view through a spout and push/pull cap stem or neck in accordance with the invention.
Figure 2:
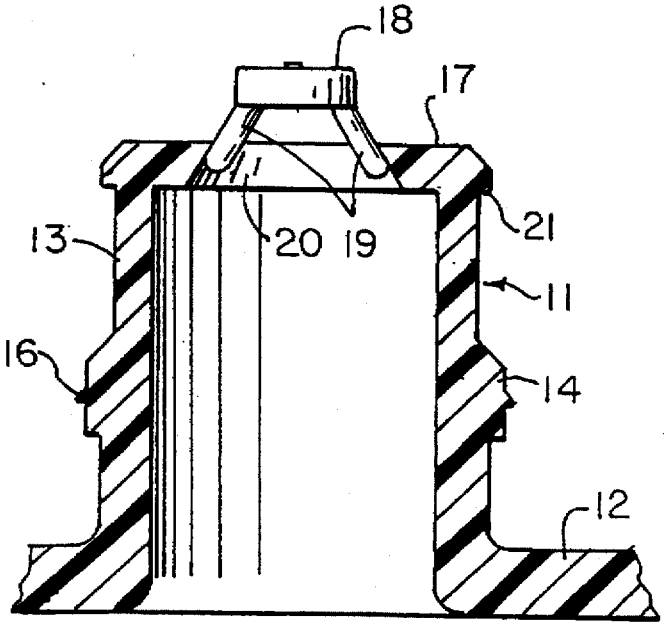
FIG. 2 is a sectional view through the cap stem or neck of FIG. 1.

As illustrated in FIGS. 1 and 2, stem 11 extends up from the annular main cap top 12 and has a generally vertical wall 13 on which is formed an external bead 14. Extending outwardly from the periphery of bead 14 is a snap-lock ring 16 having a horizontal shoulder on its underside and an upwardly, inwardly slanted upper surface. The upper end of wall 13 has a top 17 formed with an opening 20. Spaced above top 17 is a tip 18 joined to top 17 by downwardly, outwardly slanted legs 19. On the exterior of top 17 a shoulder 21 is formed.

Push/pull spout 26 is formed with a top 27 having an opening 28 which is closed by tip 18 in the closed position of the cap illustrated in FIG. 1. However, it is well understood in the push/pull cap art, when the spout 26 is raised relative to stem 11, the opening 28 is exposed and liquid within the container may be dispensed. Below top 27 is a skirt 29 formed with an internal retainer 31 which engages shoulder 21 to prevent removal of the spout 26. Skirt 29 terminates in a bottom edge 32, in FIG. 3.

Figure 4:
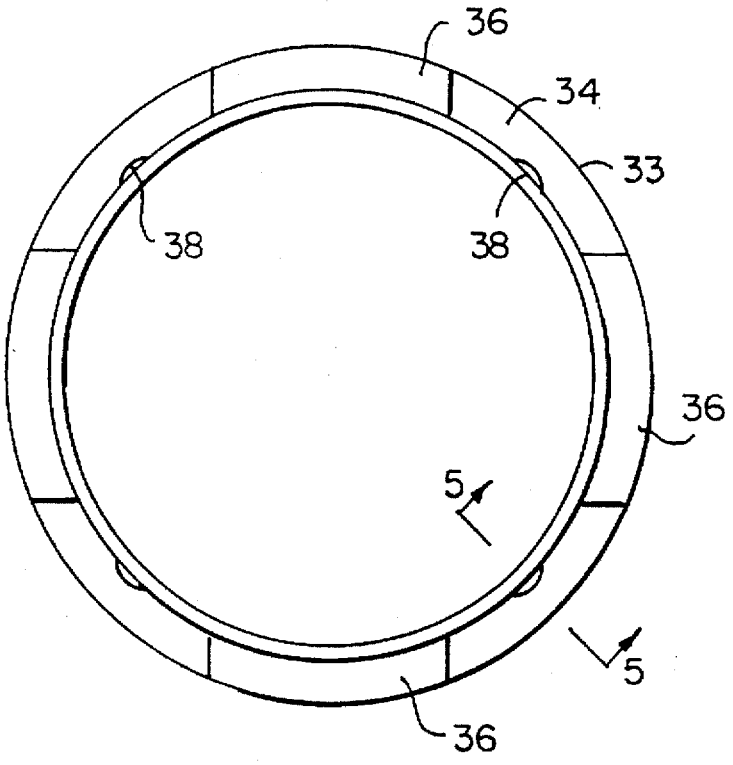
FIG. 4 is a top view of the drop band of the spout of FIG. 1.

Spaced below edge 32 is a band 33 having an upper edge 34. Extending a small distance above edge 34 is a plurality of bumpers 36. As illustrated in FIG. 4 there are four bumpers 36 each approximately 45° in arcuate length. Intermediate consecutive bumpers 36 are thin vertical bridges 38 which connect the band 33 to the skirt 29. The spout 26 may not be slid upward on stem 11 so long as the bridges 38 are intact. However, when the consumer wishes to dispense liquid, the spout 26 is pulled upward, fracturing the bridges 38.

Heretofore when spouts of this general type were pushed onto the stems, the band 33 engaged the retaining means on the stem so that the bridges 38 tended to be crushed and fractured, thereby giving a false signal of tampering. The use of bumpers such as bumpers 36 reduced the tendency of the bridges to fracture but required mold fabrication techniques which either made the part difficult to eject from the mold or tended to break the bridges during the ejection of the spout from the mold.

In order to retain conventional tear band on the spout, such bands have heretofore been formed with internal beads approximately midway of the height of the band which engage grooves or corresponding beads on the exterior of the cap stem. Ejection of such beads from the molds required special mold constructions and even then there was a tendency of the bridges to be fractured by tension when the parts were ejected.

Figure 3:
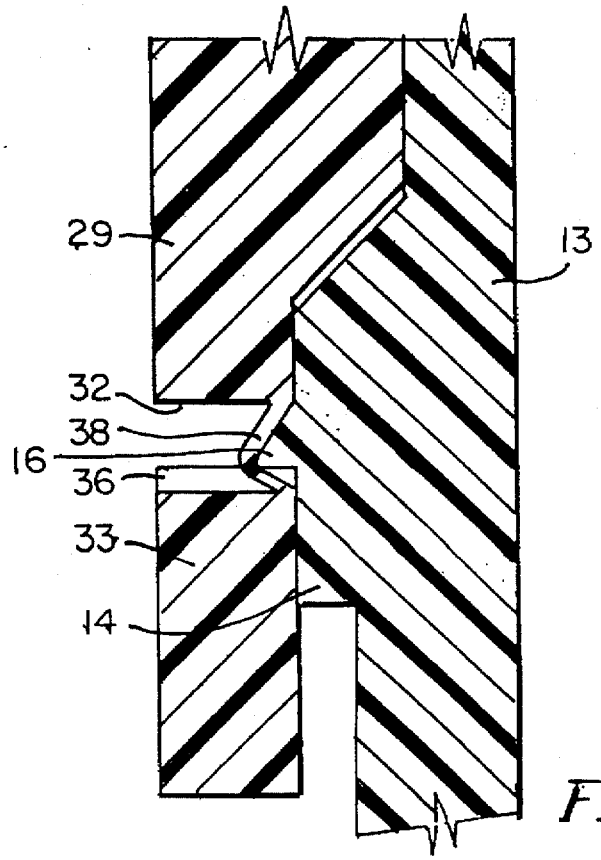
FIG. 3 is an enlarged sectional view of a portion of the structure of FIG. 1.
Figure 5:
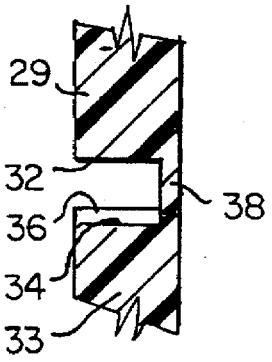
FIG. 5 is an enlarged sectional view of a portion of the spout similar to FIG. 3 but prior to assembly on the cap stem or neck.

In the assembled position of the cap stem and the spout shown in FIG. 1 the snap-lock ring 16 engages the top surfaces of bumpers 36. The bridges 38 are bowed outwardly as required, as best shown in FIG. 3. Hence the snap-lock ring 16 functions to hold the band 33 in place, eliminating the necessity of separate beads on the snap band engaging grooves or beads on the exterior of the cap stem.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a cap and a neck over which said cap fits, said cap comprising a skirt having a bottom edge, a drop band below said skirt and a plurality of bridges interconnecting said skirt and said band, said neck comprising an external bead engaging said skirt and said band and an external ring extending outward of said bead positioned to protrude outward above said band when said cap is assembled on said neck to restrain upward movement of said cap relative to said neck while said bridges are intact, said ring engaging and bowing outwardly said bridges.

2. The combination of claim 1 in which said external ring is continuous.

3. The combination of claim 1 in which said external ring is intermittent.

4. The combination of claim 1 which further comprises cooperating means on said cap and said neck to restrict longitudinal movement of said cap relative to said neck, said external bead comprising said cooperating means on said neck.

5. The combination of claim 1 which further comprises cooperating means on said skirt and said neck to restrain removal of said cap relative to said neck after said bridges have been broken.

6. The combination of claim 1 in which said neck comprises a spout having a spout top formed with a spout opening, a tip spaced above said opening and means interconnecting said tip and said spout top and in which said cap comprises a cap top formed with a cap opening, said cap being longitudinally movable on said spout when said bridges are broken between a closed position and an open position, said bridges restraining said spout in closed position so long as said bridges are intact.

7. The combination of claim 6 which further comprises cooperating means on said spout and said cap to restrain movement of said spout relative to said cap beyond open position.

8. In combination, a cap and a neck over which said cap fits; said cap comprising a skirt having a bottom edge, a drop band below said skirt and a plurality of bridges interconnecting said skirt and said band, said neck comprising an external ring positioned to protrude above said band when said cap is assembled on said neck to restrain upward movement of said cap relative to said neck while said bridges are intact, said band having an upper edge and a plurality of circumferentially spaced bumpers extending above said upper edge, said bumpers having top surfaces slightly elevated above said upper edge of said band, said ring engaging said top surfaces of said bumpers.

9. The combination of claim 8 in which the arcuate length of each said bumper is approximately 45°.

10. In combination, a cap and a neck over which said cap fits, said cap comprising a skirt having a bottom edge, a drop band below said skirt and a plurality of bridges interconnecting said skirt and said band, said neck comprising an external ring positioned to protrude above said band when said cap is assembled on said neck to restrain upward movement of said cap relative to said neck while said bridges are intact, said band having an upper edge comprising a level top surface and which further comprises a plurality of circumferentially spaced bumpers extending from the upper edge of said band, said bumpers having bottom surfaces extending slightly below said cap skirt, said ring engaging said top surface.

* * * * *